US008910686B2

(12) United States Patent
Ushidate

(10) Patent No.: US 8,910,686 B2
(45) Date of Patent: Dec. 16, 2014

(54) LABEL SUPPLYING DEVICE

(75) Inventor: Toshiyuki Ushidate, Habikino (JP)

(73) Assignee: Fuji Seal International, Inc., Osaka-shi (JP)

( * ) Notice: Subject to any disclaimer, the term of this patent is extended or adjusted under 35 U.S.C. 154(b) by 535 days.

(21) Appl. No.: 13/375,952

(22) PCT Filed: May 17, 2010

(86) PCT No.: PCT/JP2010/058282

§ 371 (c)(1),
(2), (4) Date: Dec. 2, 2011

(87) PCT Pub. No.: WO2010/140463

PCT Pub. Date: Dec. 9, 2010

(65) Prior Publication Data

US 2012/0073759 A1 Mar. 29, 2012

(30) Foreign Application Priority Data

Jun. 4, 2009 (JP) ..... 2009-134720

(51) Int. Cl.
*B65C 9/40* (2006.01)
*B65C 3/06* (2006.01)

(52) U.S. Cl.
CPC ..... *B65C 3/065* (2013.01)
USPC ..... 156/353; 156/361; 156/367

(58) Field of Classification Search
CPC ..... B65C 9/40; B65C 9/42; B32B 41/00; B32B 41/02; B29C 69/005; B29C 66/93
USPC ..... 156/353, 354, 361, 367
See application file for complete search history.

(56) References Cited

U.S. PATENT DOCUMENTS

| | | | | |
|---|---|---|---|---|
| 6,923,884 | B2 | 8/2005 | Eiban | |
| 7,343,949 | B1 * | 3/2008 | Vandevoorde | 156/351 |
| 2003/0145702 | A1 * | 8/2003 | Eiban | 83/54 |

FOREIGN PATENT DOCUMENTS

| | | |
|---|---|---|
| JP | A-09-077032 | 3/1997 |
| JP | A-2002-128038 | 5/2002 |
| JP | A-2004-026300 | 1/2004 |

OTHER PUBLICATIONS

International Search Report in International Application No. PCT/JP2010/058282; dated Jun. 29, 2010 (with English-language translation).

* cited by examiner

*Primary Examiner* — George Koch
(74) *Attorney, Agent, or Firm* — Oliff PLC

(57) ABSTRACT

A label supplying device is provided, whereby false bonding at a cylindrical label's end is reliably released, and ill-timed supplying of the label to the label supply position hardly occurs. The supplying device includes: a material delivery unit (10) for continuously delivering an elongated label base material (M) paid out from a material roll by a pay-out unit; a cutting unit (20) for cutting, at a predetermined pitch, the base material (M) delivered by the delivery unit (10); an upstream and a downstream belt transfer units (30, 40) for transferring labels (L), formed by the cutting of the cutting unit (20), to a label supply position (α); and a separation unit (50) for separating overlapping edges of the upper end of the label (L) (upstream end in the transfer direction of the label (L)) during the transferring of the label (L) by the upstream transfer unit (30).

2 Claims, 14 Drawing Sheets

Related Art

LABEL SUPPLYING DEVICE

This application is a national stage entry of PCT/JP2010/058282, filed on May 17, 2010.

TECHNICAL FIELD

The present invention relates to a label supplying device to be incorporated in a labeling system for attaching cylindrical labels, such as stretch labels or shrink labels, to attachment targets, i.e., bottles or other sorts of containers.

BACKGROUND ART

A labeling system is used for attaching cylindrical labels, such as stretch labels or shrink labels, to the outer body surfaces of various bottles. Such a labeling system is provided with a label supplying device designed to make cuts consecutively in a label base material in the form of an elongated folded sheet to provide closely arranged cylindrical labels. Through the cutting, the label base material is formed into cylindrical labels each having a predetermined length. These cylindrical labels of the predetermined length are forwarded by the label supplying device to the following label attaching device.

As shown in FIG. 18, the label supplying device includes a delivery roller 101 for delivering a label base material M in the form of an elongated folded sheet, a cutting unit 102 for cutting the label base material M delivered by the delivery roller 101 into a predetermined length to form individual cylindrical labels L, and a belt transfer unit 103 for transferring the cylindrical labels L of the predetermined length to a label supply position α. The belt transfer unit 103 transfers the labels L, which are formed by the cutting operation and have a predetermined length, to the label supply position α. For this transfer, the labels L are sucked onto a pair of feed belts 103*a*, 103*a* arranged parallel to each other with a predetermined space between them.

As noted above, the long strip-like label base material M is cut into cylindrical labels L. Unfavorably, in each resulting label L, the cut edges at an end falsely stick together. As a result, in opening the folded sheet of the cylindrical label L, the label fails to open properly, and hence, fails to be attached to a bottle smoothly and reliably. To avoid this problem, the label supplying device 100 of this kind includes a label edge separation unit 104 for separating the overlapping edges of the folded sheet of the cylindrical label L during the transferring of the cylindrical label L by the belt transfer unit 103.

As illustrated in the figure, the label edge separation unit 104 is arranged to face the feed belts 103*a*, 103*a* across the transfer line of the cylindrical label L, and includes three guide rollers 104*a*, a driving pulley 104*b*, and belts 104*c*, 104*c* wound around these rollers and pulley. The driving pulley 104*b* is driven by a servomotor operable independently from the servomotor for circulating the feed belts 103*a*, 103*a*.

The rotation speed of the driving pulley 104*b* is set so that the belts 104*c*, 104*c* circulate at a higher speed than that of the feed belts 103*a*, 103*a*. The overlapping edges of the cylindrical label L, sandwiched between the belts 104*c*, 104*c* and the feed belts 103*a*, 103*a*, will be separated from each other due to the difference in speed between the movement of the belts 104*c*, 104*c* and that of the feed belts 103*a*, 103*a*.

RELATED ART DOCUMENT

Patent Document 1: JP-A-2004-26300

SUMMARY OF THE INVENTION

Problems to be Solved by the Invention

However, in the above-described label supplying device 100, the belts 104*c*, 104*c* of the label edge separation unit 104 come into contact with the entire length of the cylindrical label L transferred by the feed belts 103*a*, 103*a*, when the label L is sandwiched between the belts 104*c*, 104*c* and the feed belts 103*a*, 103*a*. In such an arrangement, together with the speed difference between the feed belts 103*a*, 103*a* and the belts 104*c*, 104*c*, the cylindrical label L being transferred by the feed belts 103*a*, 103*a* of the belt transfer unit 103 will deviate in position on the feed belts 103*a*, 103*a*, due to the contact with the belt 104*c*, 104*c*. As a result, the timing may be wrong when the cylindrical label L is supplied to the label supply position α.

Another problem is that the belts 104*c*, 104*c* are caused to slide directly on the feed belt 103*a*, 103*a* where the cylindrical label L is not sandwiched by the belts 104*c*, 104*c*. As a result, the feed belts 103*a*, 103*a* and the belts 104*c*, 104*c* unduly wear.

It is therefore an object of the present invention to provide a label supplying device by which the falsely bonded edges at an end of a cylindrical label can be reliably separated, while ensuring that the cylindrical label is supplied to the label supply position at proper timing, and that the feed belts of the belt transfer unit are prevented from wearing easily.

Means for Solving the Problems

To solve the above-described problems, an embodiment of the invention provides a label supplying device comprising: a label base material delivery unit for continuously delivering a label base material in the form of an elongated strip; a label base material cutting unit for cutting, at a predetermined cut pitch, the label base material delivered by the label base material delivery unit, to form cylindrical labels in a state of a folded sheet; a belt transfer unit for transferring the cylindrical labels one by one to a label supply position; and a label edge separation unit for separating overlapping edges of an end of each of the cylindrical labels in the state of a folded sheet during the transferring of the cylindrical labels by the belt transfer unit. The belt transfer unit includes a pair of feed belts for transferring the cylindrical labels while holding the cylindrical labels by suction, and the feed belts are arranged parallel to each other with a predetermined space between them. The label edge separation unit includes: a first free roller arranged between the paired feed belts of the belt transfer unit and on a side of the cylindrical label where the feed belts are disposed; a speed variable roller or a speed variable belt mechanism that is arranged to sandwich the cylindrical labels in line contact with the cylindrical labels by cooperating with the first free roller, where the speed variable roller or the speed variable belt mechanism is driven for rotation by an independent servomotor in the direction of transfer of the cylindrical labels; a pair of second free rollers each arranged to sandwich the cylindrical labels by cooperating with a respective one of the paired feed belts of the belt transfer unit; and a controller for controlling operation of the speed variable roller or the speed variable belt mechanism. The controller controls the servomotor such that the peripheral speed of the speed variable roller or movement speed of a speed variable belt of the speed variable belt mechanism is equal to the movement speed of the paired feed belts of the belt transfer unit when portions of each cylindrical label other than one end passes through the sandwiching portion between the first free roller and the speed variable roller or the speed variable belt mechanism, whereas the controller controls the servomotor such that the peripheral speed of the speed variable roller or movement speed of the speed variable belt of the speed variable belt mechanism is different from the movement speed of the paired feed belts of the belt transfer unit when one end of the cylindrical label passes through the sandwiching portion between the first free roller and the speed variable roller or the speed variable belt mechanism.

An embodiment of the invention provides a label supplying device comprising: a label base material delivery unit for continuously delivering a label base material in the form of an elongated strip; a label base material cutting unit for cutting, at a predetermined cut pitch, the label base material delivered by the label base material delivery unit, to form cylindrical labels in a state of a folded sheet; a belt transfer unit for transferring the cylindrical labels one by one to a label supply position; and a label edge separation unit for separating overlapping edges of an end of each of the cylindrical labels in the state of a folded sheet during the transferring of the cylindrical label by the belt transfer unit. The belt transfer unit includes a pair of feed belts for transferring the cylindrical labels while holding the cylindrical labels by suction, and the feed belts are arranged parallel to each other with a predetermined space between them. The label edge separation unit includes: a driving roller arranged between the paired feed belts of the belt transfer unit and on a side of the cylindrical labels where the feed belts are disposed, the driving roller having a peripheral speed equal to the movement speed of the paired feed belts of the belt transfer unit; a speed variable roller or a speed variable belt mechanism arranged to sandwich the cylindrical labels in line contact with them by cooperating with the driving roller, where the speed variable roller or the speed variable belt mechanism is driven for rotation by an independent servomotor in the direction of transfer of the cylindrical labels; and a controller for controlling the operation of the speed variable roller or the speed variable belt mechanism. The controller controls the servomotor such that the peripheral speed of the speed variable roller or movement speed of a speed variable belt of the speed variable belt mechanism is equal to the movement speed of the paired feed belts of the belt transfer unit when portions of the cylindrical labels other than one end pass through the sandwiching portion between the driving roller and the speed variable roller or the speed variable belt mechanism, whereas the controller controls the servomotor such that the peripheral speed of the speed variable roller or movement speed of the speed variable belt of the speed variable belt mechanism is different from the movement speed of the paired feed belts of the belt transfer unit when one end of the cylindrical label passes through the sandwiching portion between the driving roller and the speed variable roller or the speed variable belt mechanism.

Advantages of the Invention

As noted above, in the label edge separation unit mounted to the label supplying device, the cylindrical label transferred by a pair of feed belts of a belt transfer unit is sandwiched between each of paired second free rollers and a corresponding one of the feed belts. In this state, the cylindrical label is sandwiched between a first free roller and a speed variable roller or a speed variable belt mechanism at a position between the paired feed belts. When one end of the cylindrical label passes through the sandwiching portion between the first free roller and the speed variable roller or the speed variable belt mechanism, the peripheral speed of the speed variable roller or the movement speed of the speed variable belt of the speed variable belt mechanism and the movement speed of the paired feed belts of the belt transfer unit are made different. With this arrangement, the overlapping edges of an end of the cylindrical label in the state of a folded sheet are reliably separated from each other.

The speed variable roller or the speed variable belt mechanism that sandwiches the cylindrical label, cooperating with the first free roller, is in line contact with the cylindrical label. The peripheral speed of the speed variable roller or the movement speed of the speed variable belt of the speed variable belt mechanism and the movement speed of the paired feed belts of the belt transfer unit are made different only when the first free roller and the speed variable roller or the belt transfer mechanism sandwich one end of the cylindrical label, and the two speeds are kept equal at other times. With these features, the operation to separate the edges of the label by the label edge separation unit does not provide resistance to the operation to transfer the cylindrical label by the belt transfer unit, and the speed variable roller or the speed variable belt of the speed variable belt mechanism hardly slides on the feed belt. Thus, in the process of transfer of the cylindrical label by the belt transfer unit, the cylindrical label does not easily deviate in position. Further, shift of the timing of supplying the cylindrical label to the label supply position does not easily occur. Moreover, the feed belts of the belt transfer unit are not easily worn.

In the label edge separation unit provided in the label supplying device, a driving roller whose peripheral speed is equal to the movement speed of the paired feed belts of the belt transfer unit is employed, instead of the first free roller. In this way, the false bonding state at an end of the cylindrical label is reliably released even when second free rollers, provided to sandwich the cylindrical label by cooperating with the paired feed belts, are not provided. Further, also with this structure, the same advantages are obtained, i.e., shift of the timing of supplying the cylindrical label to the label supply position does not easily occur, and the feed belts of the belt transfer unit are not easily worn.

BEST MODE FOR CARRYING OUT THE INVENTION

Figure 1:
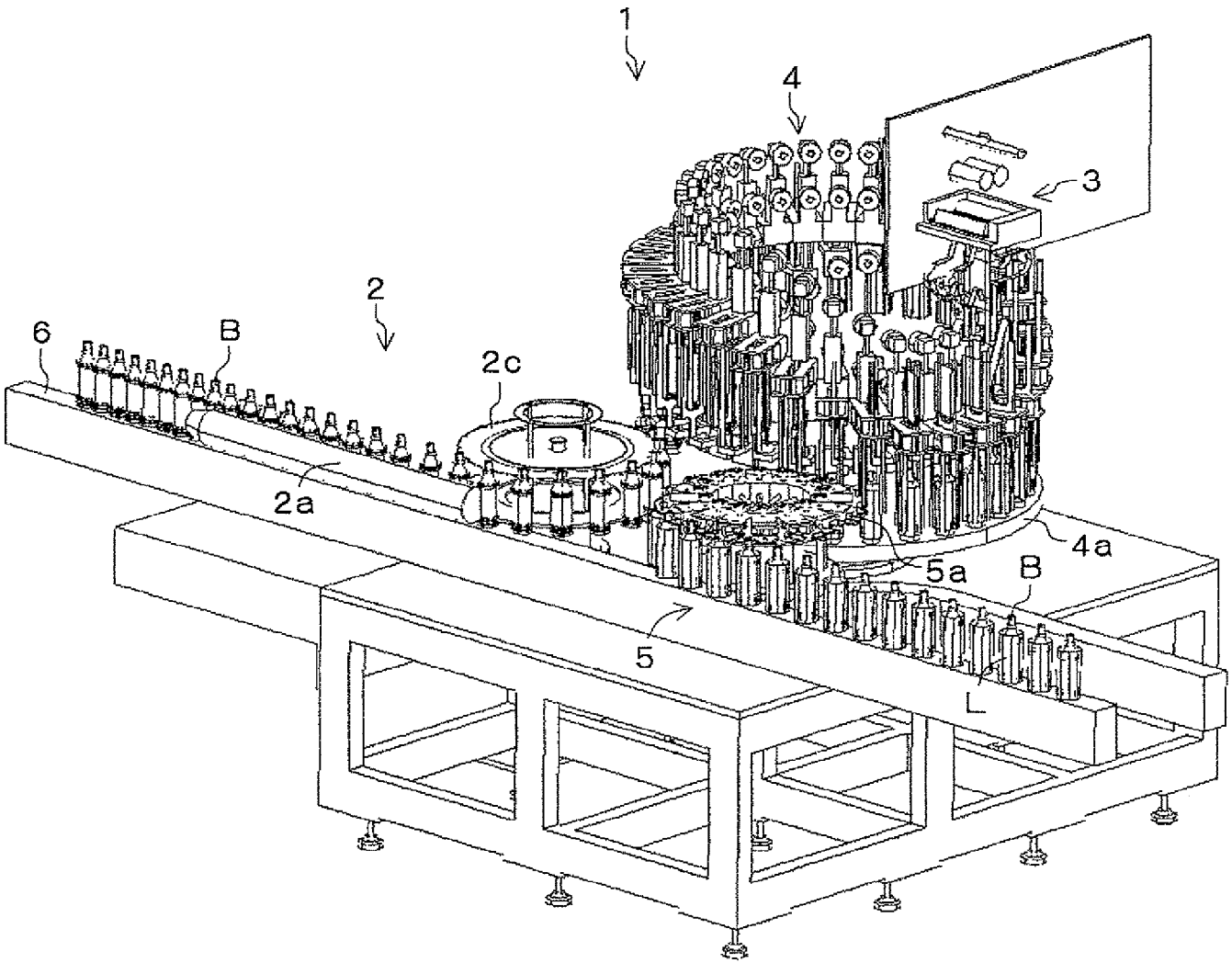
FIG. 1 is a schematic perspective view showing a labeling system to which a label supplying device according to an embodiment of the present invention is mounted.
Figure 2:
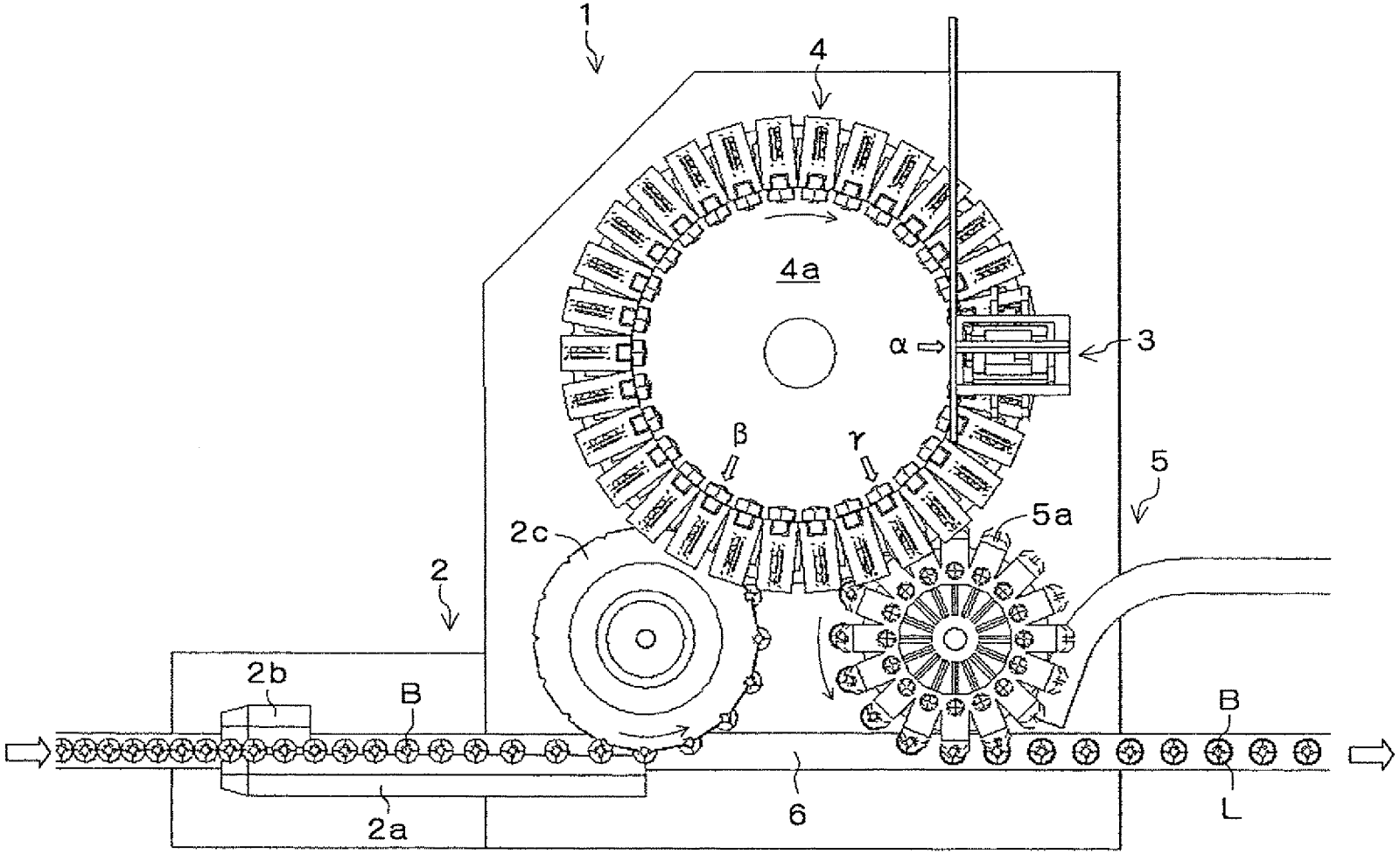
FIG. 2 is a plan view showing the labeling system.
Figure 3:
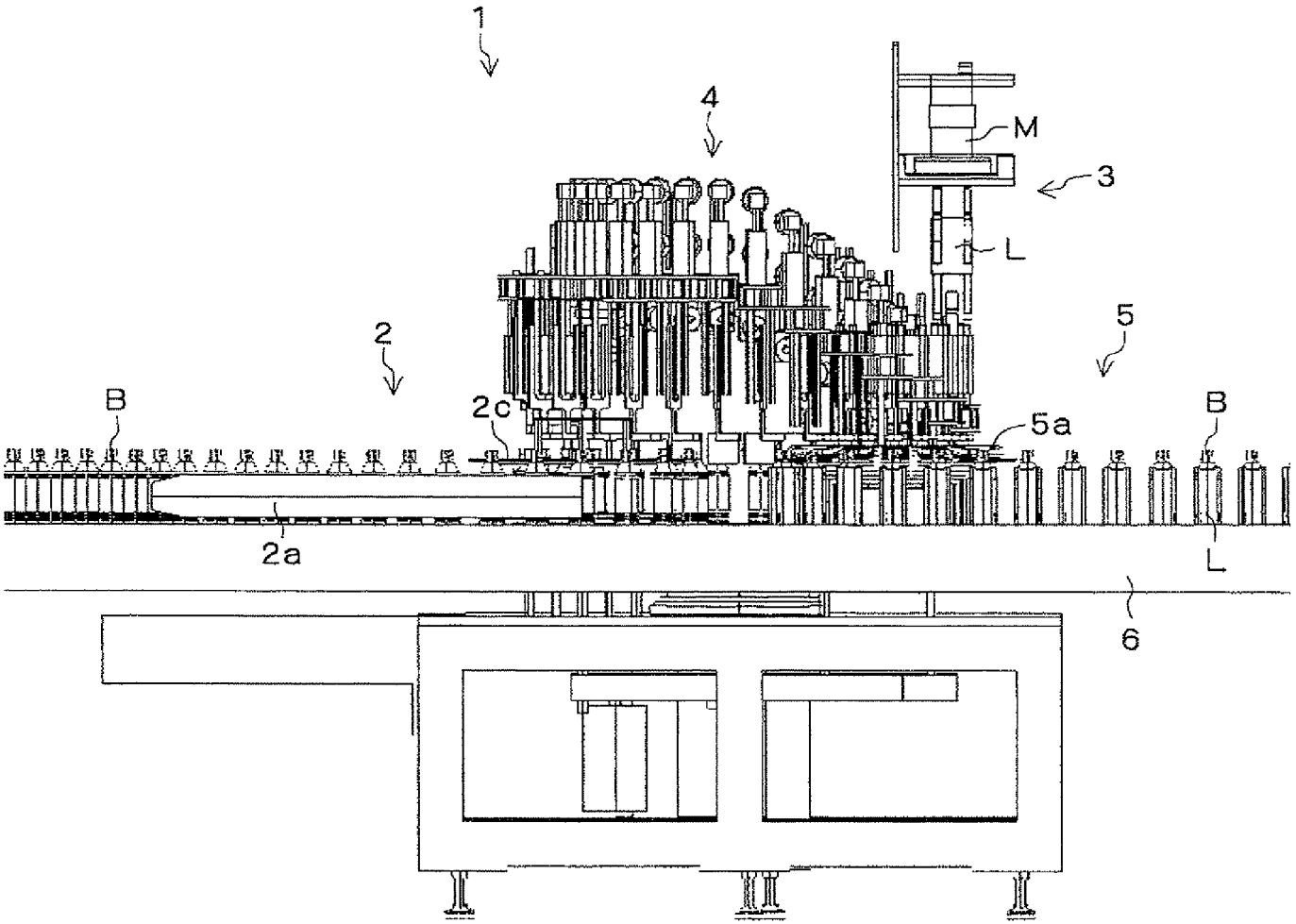
FIG. 3 is a front view showing the labeling system.

Embodiments of the present invention are described below with reference to the accompanying drawings. FIGS. 1-3 show a labeling system 1 for attaching a cylindrical shrink label (hereinafter simply referred to as "label") comprising a heat-shrinkable film made of e.g. polyester based resin or polystyrene based resin and having a thickness of 20 to 60 μm to a PET bottle (hereinafter simply referred to as "bottle"). The labeling system 1 comprises a bottle supplying device, a label supplying device, a rotary-type label attaching device and a bottle discharge device. The bottle supplying device 2 includes a belt conveyor 6, screws 2*a*, 2*b* and a star wheel 2*c*. The label supplying device 3 successively cuts an elongated label base material M paid out from a base material roll by a base material pay-out unit (not shown) to form labels L and successively supplies the labels L to a label supply position α. The label attaching device 4 receives a bottle B supplied from the bottle supplying device 2 at a bottle supply position β and transfers the bottle to a bottle feed-out position γ. The label attaching device also receives a label L from the label supplying device 3 at the label supply position α and attaches the label L to the bottle B during when the bottle B is transferred from the bottle supply position β to the bottle feed-out position γ. The bottle discharge device 5 discharges the bottle B to which the label L has been attached by the label attaching device 4. The bottle discharge device includes a bottle feed-out unit comprising a belt conveyor 6, and a bottle transfer unit 5*a* for transferring the bottle B with the attached label L to the bottle feed-out unit.

Figure 4:
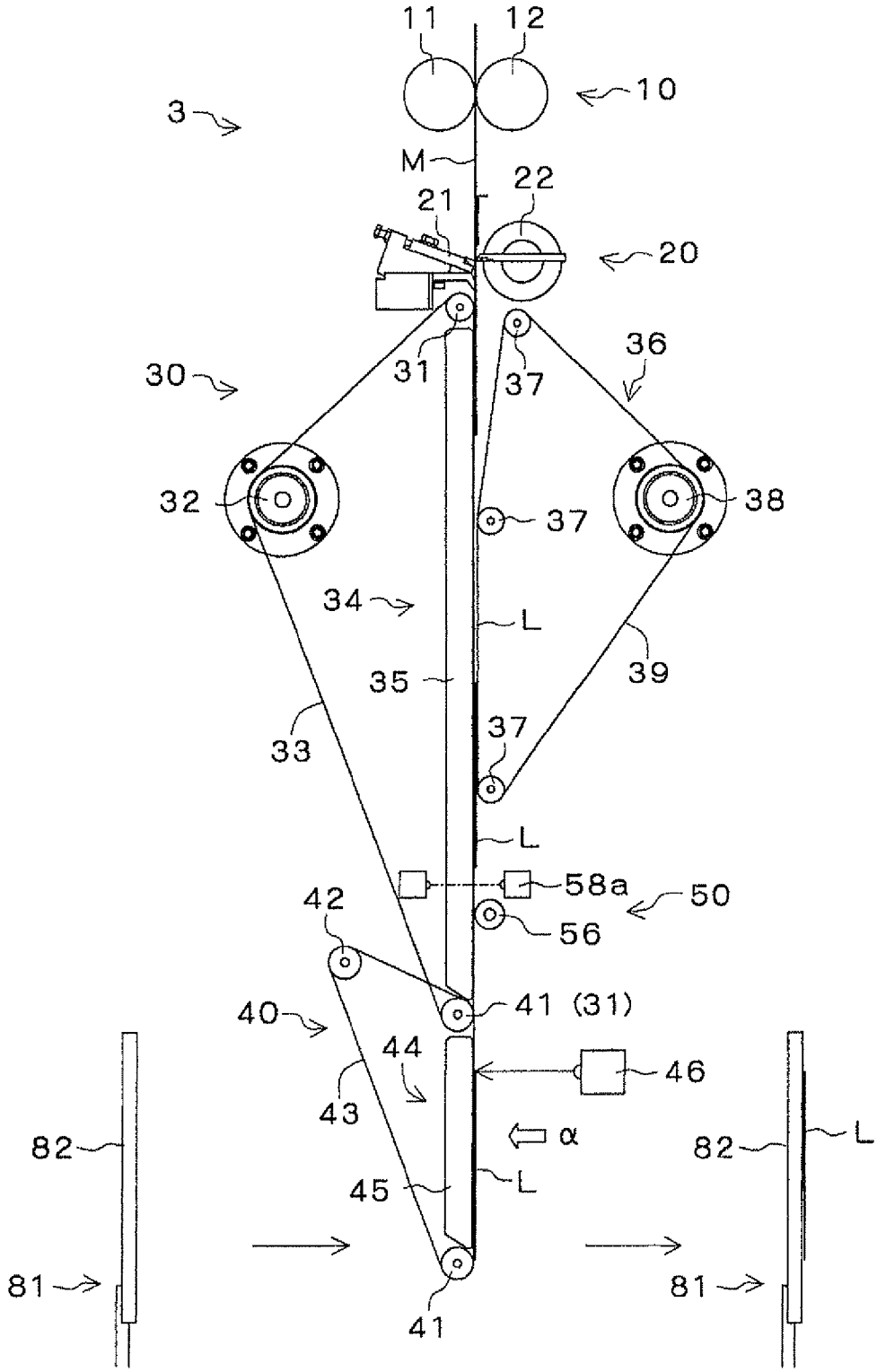
FIG. 4 is a front view of the label supplying device constituting the labeling system.
Figure 5:
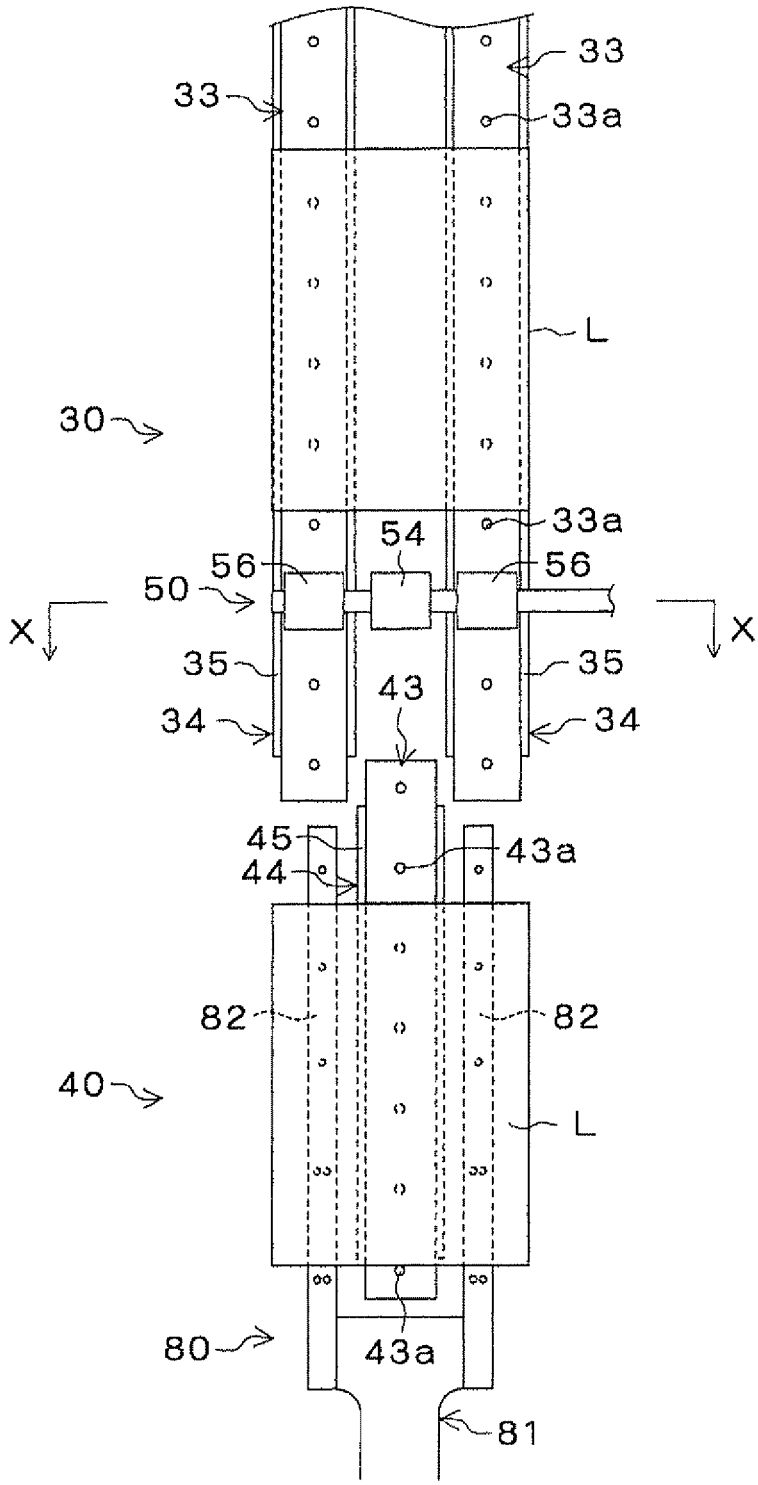
FIG. 5 is a side view of the label supplying device.

As shown in FIGS. 4 and 5, the label supplying device includes a label base material delivery unit 10 for continuously delivering the elongated label base material M paid out from a base material roll by a base material pay-out unit, a label base material cutting unit 20 for cutting the label base material M delivered by the label base material delivery unit 10 at a predetermined cut pitch, an upstream belt transfer unit 30 and a downstream belt transfer unit 40 for successively transferring the labels L, which are formed by the cutting operation by the label base material cutting unit 20, to a label supply position α, and a label edge separation unit 50 for separating overlapping edges at the upper end (upstream end in the transfer direction of the labels L) of each label L from each other.

As shown in FIG. 4, the label base material delivery unit 10 includes a driving roller 11 driven by an independent base-material-delivery servomotor (not shown), and a follower roller 12 for sandwiching the label base material M in the form of a folded sheet, cooperating with the driving roller 11. The label base material M sandwiched between the rollers 11 and 12 is delivered by the rotation of the driving roller 11 to a base material cutting position on the downstream side where the label base material cutting unit 20 is provided.

As shown in FIG. 4, the label base material cutting unit 20 includes a stationary blade 21 fixed to the base material cutting position and a rotary blade 22 driven for rotation by an independent, base-material-cutting servomotor (not shown). The label base material M continuously delivered by the label base material delivery unit 10 is successively cut every time the rotary blade 22 makes one turn, whereby labels L having a predetermined length are successively formed.

As shown in FIGS. 4 and 5, the upstream belt transfer unit 30 includes two timing feed belts 33, 33 wound around a driving timing pulley 32 and follower timing pulleys 31 arranged adjacent to the base material cutting position and adjacent to the label supply position α. The timing feed belts are circulated for movement between a position adjacent to the base material cutting position and a position adjacent to the label supply position α at a speed higher than the delivering speed of the label base material M. The upstream belt transfer unit further includes a suction mechanism 34 for sucking and retaining the labels L on the two timing feed belts 33, and a suction assistance means 36 for assisting the retaining of the labels L on the feed belts 33 by successively bringing each of the labels L into close contact with the timing feed belts 33, 33 from the lower end to the upper end of the label. The driving timing pulley 32 is driven for rotation by an independent upstream-belt-driving servomotor (not shown).

As shown in FIG. 5, the timing feed belts 33, 33 are arranged in parallel to each other with a gap between them which is smaller than the width of the label L to be transferred. Each of the timing feed belts 33, 33 is formed with a number of suction holes 33*a* aligned at regular intervals in the longitudinal direction at the center portion in the width direction.

As shown in FIG. 4, the suction mechanism 34 includes suction chambers 35, 35 respectively arranged along the timing feed belts 33, 33 between the follower timing pulleys 31, and a suction device, not shown, such as a vacuum pump connected to the suction chambers 35, 35 via e.g. a tube, not shown. The suction chambers 35, 35 have suction ports that are open at the surfaces to come into contact with the timing feed belts 33, 33.

As shown in FIG. 4, the suction assistance means 36 is arranged to face the timing feed belts 33, 33 across the transfer line of the labels L. The suction assistance means comprises three follower timing pulleys 37, a driving timing pulley 38 and a timing belt 39 wound around these pulleys. The driving timing pulley 38 is driven by the servomotor circulating the timing feed belts 33. The rotation speed of the driving timing pulley 38 is set so that the timing belt 39 moves at a speed equal to the speed of movement of the timing feed belts 33.

As shown in FIGS. 4 and 5, the downstream belt transfer unit 40 includes a single timing feed belt 43 which is wound around a driving timing pulley 42 and two follower timing pulleys 41 arranged on the upper side and the lower side of the label supply position α and which moves between the upper side and the lower side of the label supply position α. The downstream belt transfer unit 40 further includes a suction mechanism 44 for sucking and retaining the labels L on the timing feed belt 43. The driving timing pulley 42 is driven for rotation by an independent servomotor.

As shown in FIG. 5, the timing feed belt 43 has a width smaller than that of the labels L to be transferred and is formed with a number of suction holes 43*a* aligned at regular intervals in the longitudinal direction at the center portion in the width direction. The timing feed belt sucks and retains the center portion of each label L in the width direction.

As shown in FIG. 4, the suction mechanism 44 includes a suction chamber 45 arranged along the timing feed belt 43 between guide rollers 41, and a suction device, not shown, such as a vacuum pump connected to the suction chamber 45 via e.g. a tube, not shown. The suction chamber 45 has suction ports that are open at the surface to come into contact with the timing feed belt 43.

Figure 8:
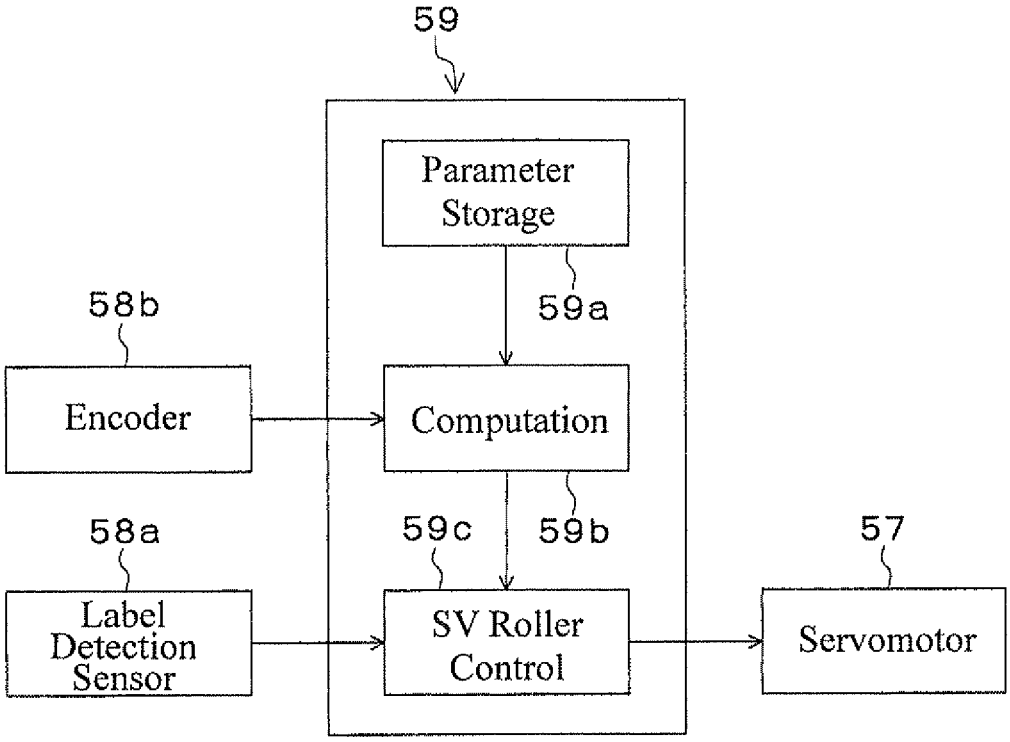
FIG. 8 is a functional block diagram of a controller mounted in the label edge separation unit.

As shown in FIGS. 4-7, the label edge separation unit 50 includes a driving roller, a speed variable roller, a pair of free rollers, a transmission-type label detection sensor, an encoder, and a controller. The driving roller 51 is disposed on the downstream side of the suction assistance means 36 of the upstream belt transfer unit 30 and between the paired suction chambers 35, 35 of the upstream belt transfer unit 30. The peripheral speed of the driving roller is equal to the movement speed of the timing feed belts 33. The speed variable roller 54 sandwiches the labels L, cooperating with the driving roller 51, and is driven for rotation in the transfer direction of the labels L by an independent servomotor 57. The paired free rollers 56, 56 are rotatably supported by the drive shaft 54*a* of the speed variable roller 54 via bearings 55, 55 and sandwich the labels L, cooperating with the paired timing feed belts 33, 33. The transmission-type label detection sensor 58*a* detects the label L transferred by the upstream belt transfer unit 30 at a position spaced upward by a predetermined distance D (e.g. 30 mm) from the position where the label L is sandwiched between the driving roller 51 and the speed variable roller 54. The encoder 58*b* (see FIG. 8) is attached to the main rotation shaft of the label attaching device 4. The controller 59 controls the peripheral speed of the speed variable roller 54 based on a label detection signal outputted from the label detection sensor 58*a* and a pulse signal outputted from the encoder 58*b* (see FIG. 8). When the upper end of the label L passes through the sandwiching portion between the driving roller 51 and the speed variable roller 54, the peripheral speed of the speed variable roller 54 and that of the driving roller 51 are made different, whereby the overlapping edges at an upper end of the label L are separated from each other. The circumferential surfaces of the driving roller 51, the speed variable roller 54 and the free rollers 56, 56 are made of a rubber material having a high frictional resistance.

Figure 6:
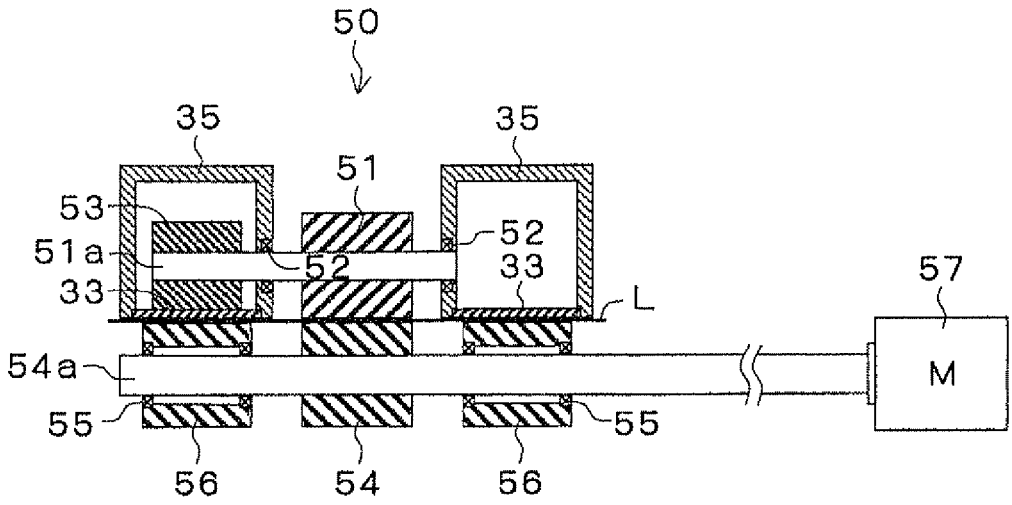
FIG. 6 is a sectional view taken along lines X-X in FIG. 5.
Figure 7:
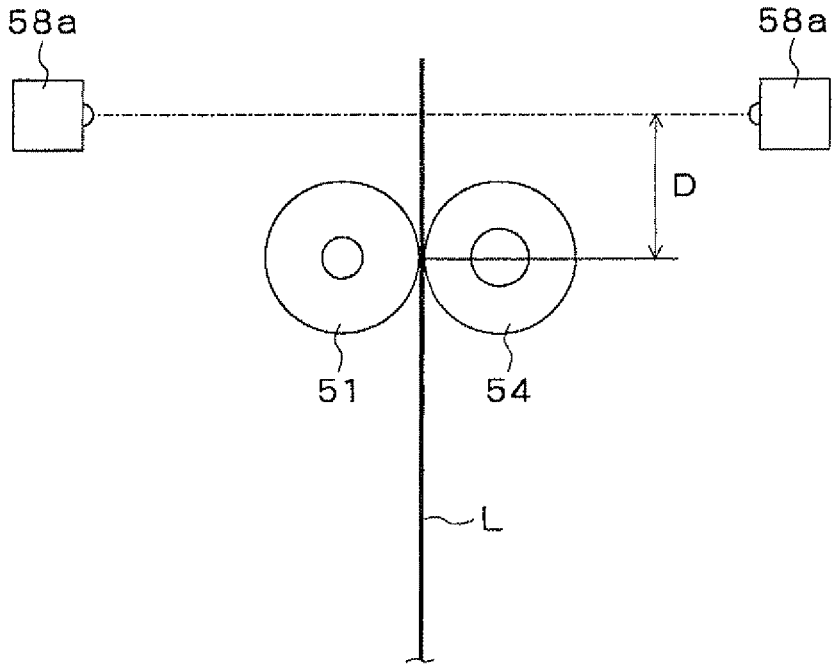
FIG. 7 is a view for describing the installation position of a label detection sensor provided in a label edge separation unit mounted to the label supplying device.

As shown in FIG. 6, the driving roller 51 has a drive shaft 51*a* rotatably supported by the paired suction chambers 35, 35 via bearings 52, 52. One end of the drive shaft 51*a* is extended into one of the suction chambers 35, and the timing pulley 53 attached to this end of the drive shaft meshes with one of the timing feed belts 33. Thus, the driving roller is driven in synchronism with the timing feed belts 33 of the upstream belt transfer unit 30.

Figure 9:
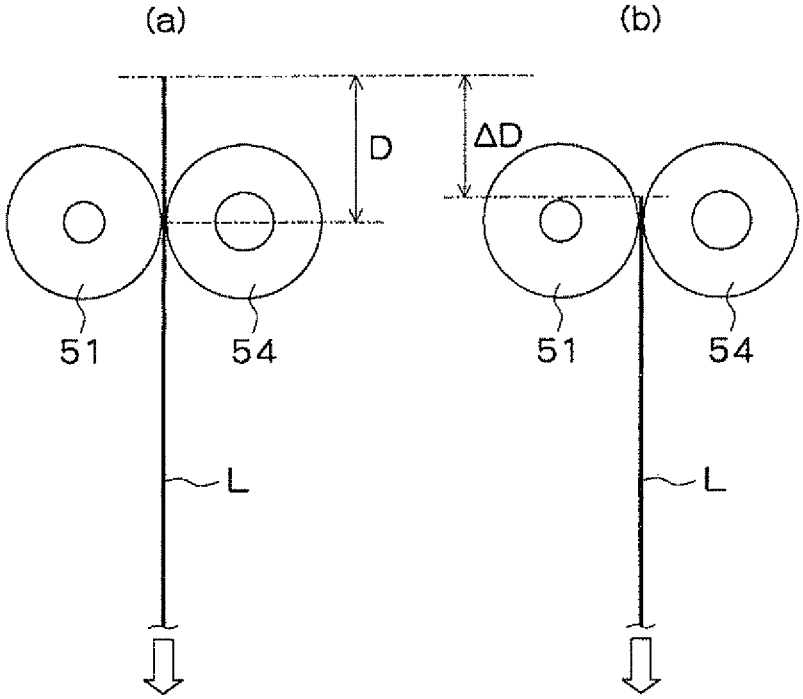
FIG. 9(*a*) shows the state in which the label detection sensor detects the upper edge of a label, whereas FIG. 9(*b*) is a view for describing a speed variable distance ΔD through which the speed of a speed variable roller provided in the label edge separation unit can be increased.
Figure 10:
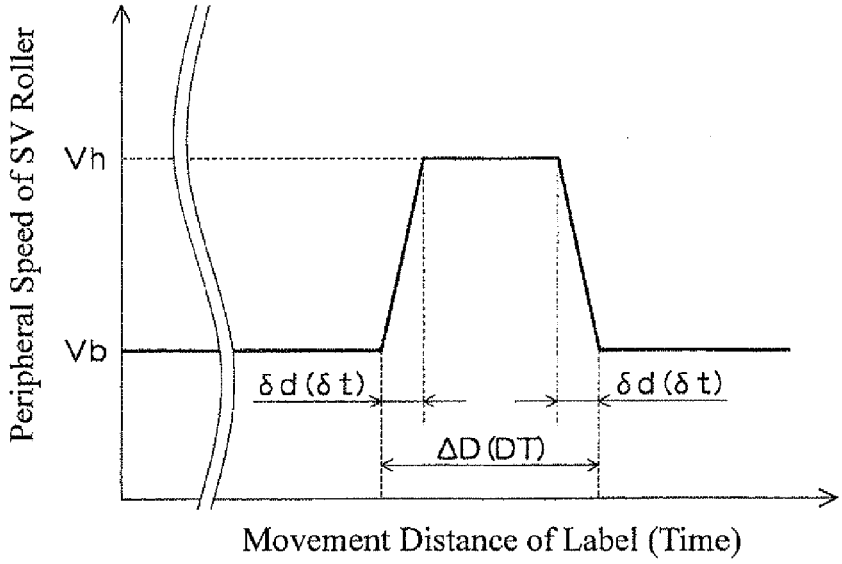
FIG. 10 is a timing chart for describing various kinds of information computed based on parameters stored in the controller.

The controller 59 is provided with a parameter storage section 59*a* for storing the parameters shown in FIGS. 9 and 10, the parameters including: the distance (hereinafter referred to as "speed variable distance ΔD") in which the peripheral speed of the speed variable roller 54 can be changed from a reference peripheral speed Vb equal to the movement speed of the timing feed belts 33; the ratio [δd/ΔD] ("speed increasable/decreasable ratio ϵ") of the movement distance of the label L in which the peripheral speed of the speedvariable roller 54 can be increased or decreased (speed increasable/decreasable distance δd) to the speed variable distance ΔD; and the ratio [Vh/Vb] ("acceleration rate ζ") of the maximum peripheral speed Vh to the reference peripheral speed Vb. The controller also includes a computation section 59*b*, which computes, based on the output pulse from the encoder 58*b*, the movement speed of the timing feed belts 33 of the upstream belt transfer unit 30 and sets this movement speed as the reference peripheral speed Vb of the speed variable roller 54. Based on the reference peripheral speed Vb and the parameters stored in the parameter storage section 59*a*, the computation section further computes, as represented in Formula 1 below, the time period ("speed variable time ΔT") in which the peripheral speed of the speed variable roller 54 can be made different from the reference peripheral speed, the time period ("speed increasable/decreasable time δt) included in the speed variable time ΔT and in which the peripheral speed of the speed variable roller 54 can be increased or decreased, and the maximum peripheral speed Vh of the speed variable roller 54. The controller further includes a speed variable roller control section 59*c* for controlling the peripheral speed of the speed variable roller 54, based on the speed variable time ΔT, speed increasable/decreasable time δt and maximum peripheral speed Vh computed by the computation section 59*b* and on label detection signals outputted from the label detection sensor 58*a*. The above-described parameters are set as follows the speed variable distance ΔD in a range of 30 mm to 5 mm, the speed increasable/decreasable ratio ϵ in a range of 0% to 50%, and the acceleration rate ζ in a range of 150% to 200%

$$\Delta T=\Delta D\div Vb$$

$$\delta t=\Delta T\cdot\epsilon$$

$$Vh=Vb\cdot\zeta \qquad \text{Formula 1:}$$

Figure 11:
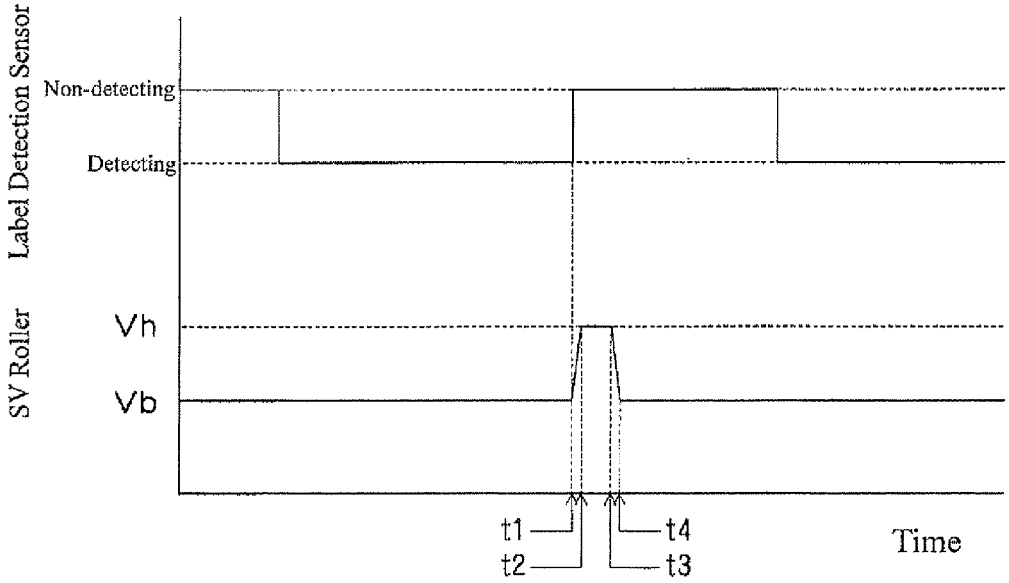
FIG. 11 is a timing chart for describing changes in the peripheral speed of the speed variable roller provided in the label edge separation unit.

The speed variable roller control section 59*c* controls the speed variable roller 54 in the manner shown by the timing chart of FIG. 11. Specifically, until the label detection sensor 58*a* detects the upper end of the label L, the speed variable roller control section 59*c* rotates the speed variable roller 54 at the reference peripheral speed Vb, similarly to the driving roller 51. Then, the speedvariable roller control section 59*c* temporarily increases the peripheral speed of the speed variable roller 54 from the reference peripheral speed Vb to the maximum peripheral speed Vh (about 1.5 to 2 times the reference peripheral speed Vb) in the period from the time t1 when the label detection sensor 58*a* detects the upper end of the label L (the time when the situation changes from the label detecting state to the label non-detecting state), namely, the time (see FIG. 9(*a*)) when the driving roller 51 and the speed variable roller 54 sandwich the label L at a point lower than the upper end of the label L by a predetermined distance D (e.g. 30 mm) until the label L travels the speed variable distance ΔD (e.g. 25 mm) (see FIG. 9(*b*)). Specifically, the servomotor 57 is controlled so that the peripheral speed is increased to the maximum peripheral speed Vh in the period from the label detection time t1 to the time t2 when the speed increasable/decreasable time δt elapses, then maintained at the maximum peripheral speed Vh for a predetermined period of time till the time t3 (speed variable time ΔT−2×speed increasable/decreasable time δt), then returned to the reference peripheral speed Vb by the time t4 when the speed increasable/decreasable time δt elapses, and then maintained at the reference peripheral speed Vb until the upper end of the next label L is detected.

The label supplying device 3 is further provided with a control unit, not shown. The control unit controls the operation of the label base material delivery unit 10, the label base material cutting unit 20, the upstream belt transfer unit 30 and the downstream belt transfer unit 40, in synchronism with the operation of the label attaching device 4, based on the label detection signal outputted from a label detection sensor 46 for detecting the upper end of the label L transferred from the upstream belt transfer unit 30 at an upper portion of the downstream belt transfer unit 40, and the pulse signal outputted from the encoder attached to the main rotation shaft of the rotary label attaching device 4. When the label L is detected by the label detection sensor 46 at an improper timing, the movement speed of the timing feed belt 43 of the downstream belt transfer unit 40 is adjusted in accordance with the amount of the timing shift. Thus, the label L is transferred while the shift of timing of supplying the label L caused by the deviation in position of the label L is corrected, so that the label L is finally stopped at the label supply position α always at the proper timing.

As shown in FIGS. 1-3, 12 and 13, the label attaching device 4 includes a support disk 4*a* attached to a rotation shaft (not shown), and a number of label attaching heads 60 standing on the support disk at regular intervals on a circle with the rotation shaft at the center. Each of the label attaching heads 60 opens the cylindrical label L received at the label supply position α in the form of a folded sheet. The label L opened in this way is attached to the body of a bottle B received at the bottle supply position β during when the bottle is transferred to the bottle feed-out position γ.

Figure 12:
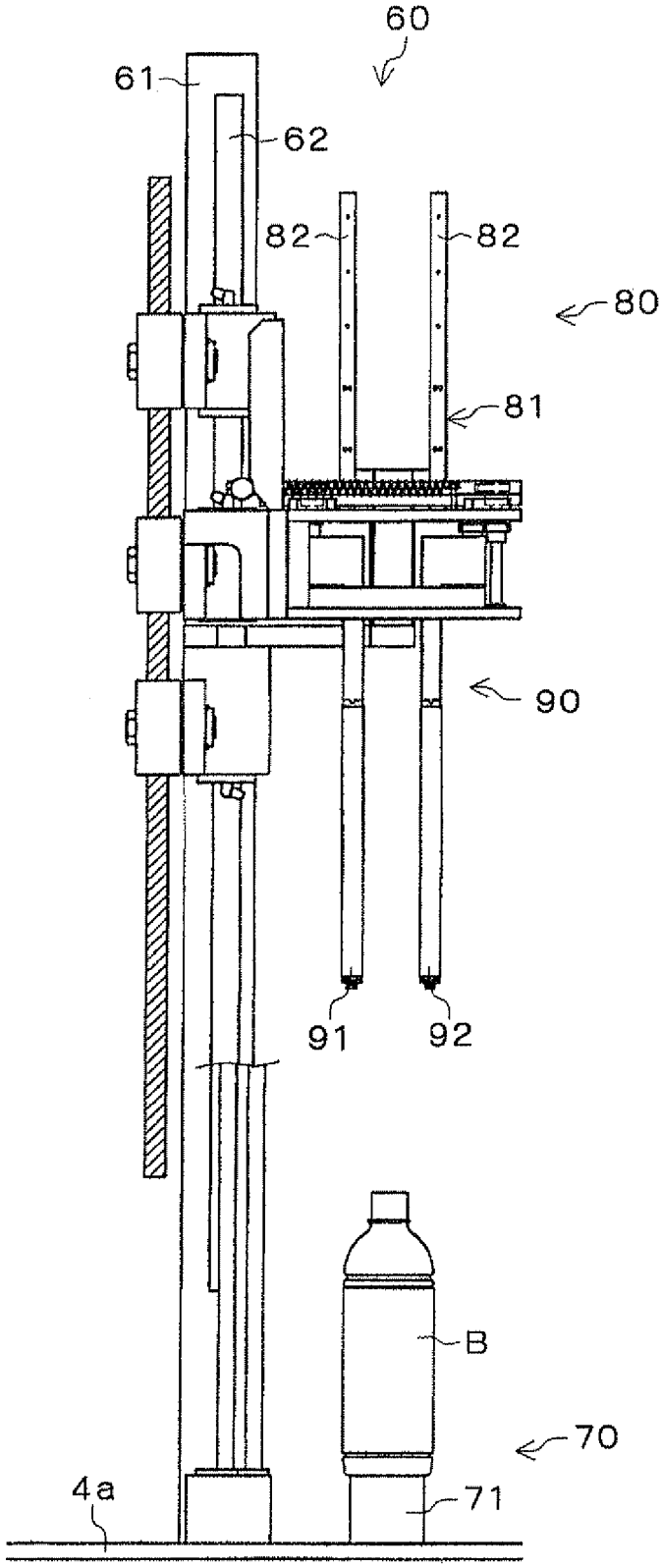
FIG. 12 is a side view showing a label attaching head mounted to the label attaching device constituting the labeling system.
Figure 13:
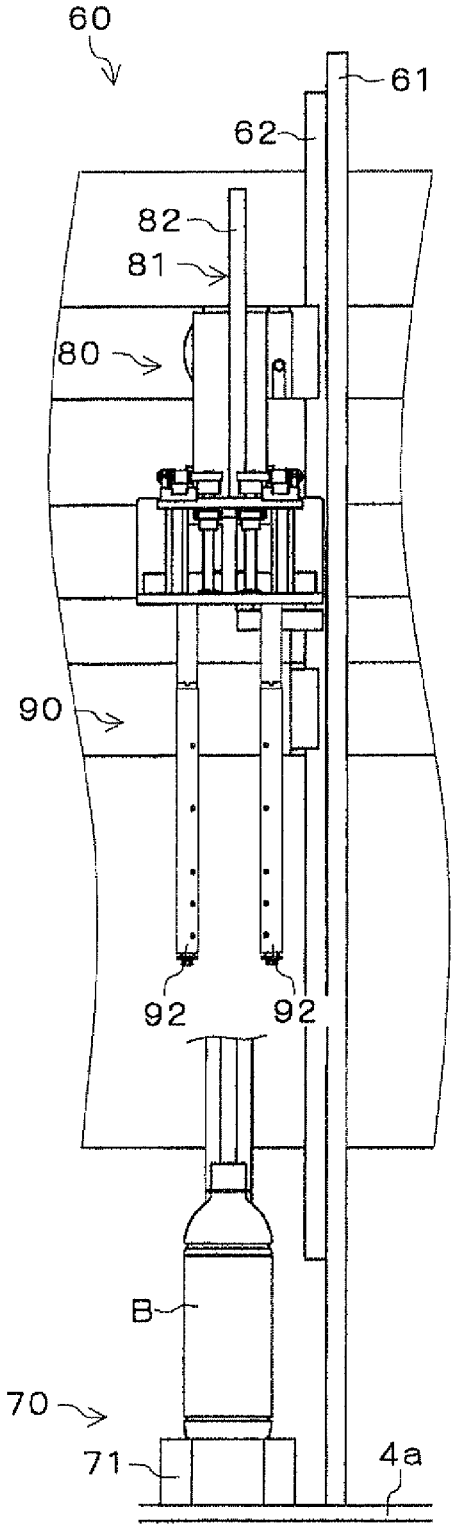
FIG. 13 is a front view showing the label attaching head.

As shown in FIGS. 12 and 13, the label attaching head 60 includes a bottle holder unit 70. The bottle holder unit includes a bottle supporting base 71 which is fixed on the support disk 4*a* and on which a bottle B received at the bottle supply position β is to be placed, and a suction means, not shown, for sucking the bottom of the bottle B placed on the bottle supporting base 71 to hold the bottle B on the bottle supporting base 71. The label attaching head further includes a label opener 90 which receives, via a label handing unit 80, the label L supplied to the label supply position α, opens the label L into a cylindrical shape and then attaches the opened label L to the body of a bottle B. The label handing unit 80 and the label opener 90 are movable up and down along a slide rail 62 fixed to a plate-like support frame 61 standing on the support disk 4*a*.

As shown in FIGS. 5, 12 and 13, the label handing unit 80 includes a take-up member 81 that includes a pair of suction bars 82, 82 that pass outside the timing feed belt 43 of the downstream belt transfer unit 40 at the label supply position α. When the paired suction bars 82, 82 pass outside the timing feed belt 43 of the downstream belt transfer unit 40 at the label supply position α, the suction bars 82, 82 hook the label L supplied to the label supply position α at portions projecting out of the timing feed belt 43 and hold the label L by suction on the suction surface side of the timing belt 43. In this way, the take-up member 81 receives the label L.

As shown in FIGS. 12 and 13, the label opener 90 includes two pairs of suction bars 91, 91 and 92, 92 which are movable to open and close to hold both sides of the label L by suction. The two pairs of suction bars 91, 91 and 92, 92 receive the label L from the label handing unit 80, open the label, and then attach the label to the body of a bottle B in the manner described below.

Figure 14:
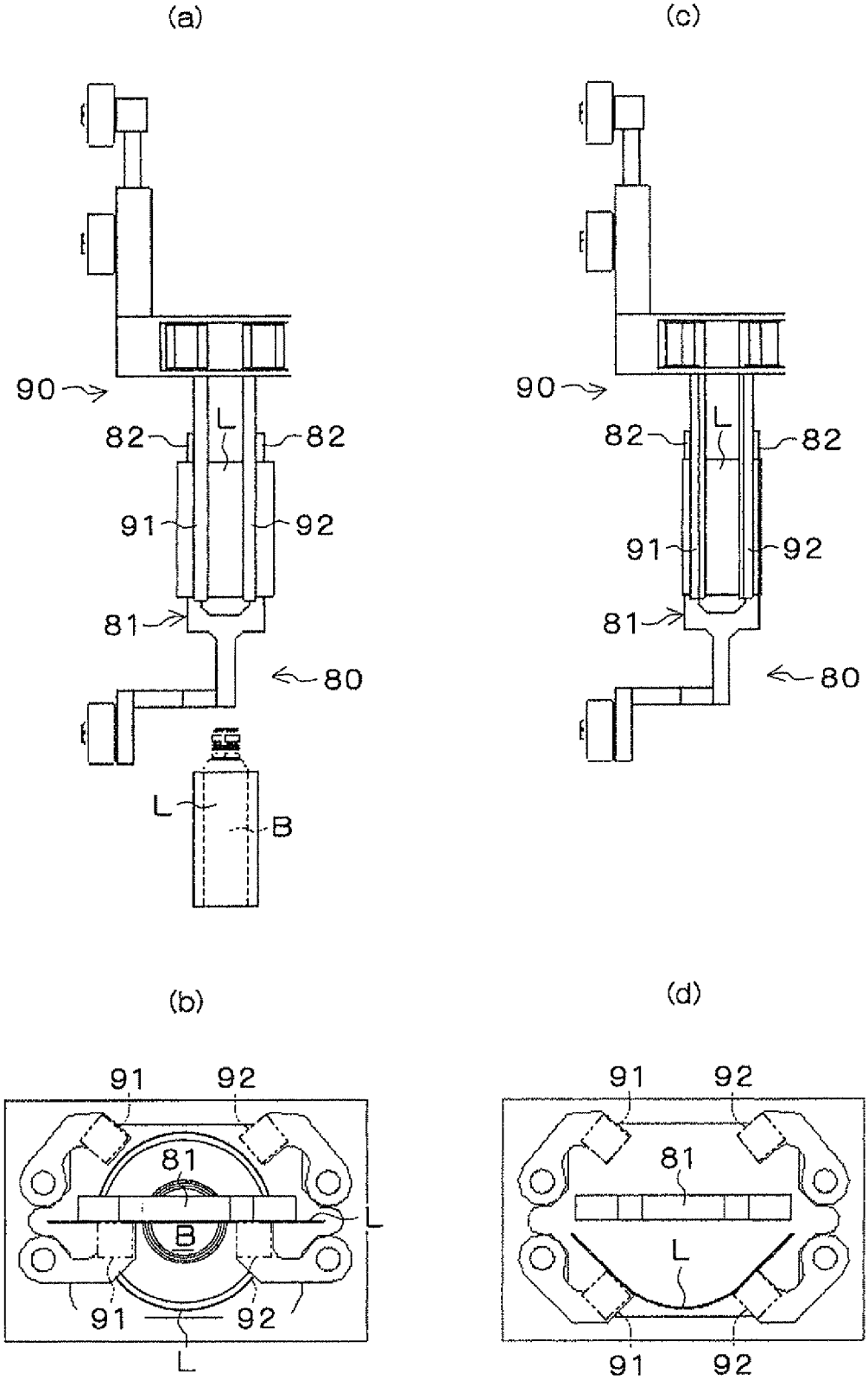
FIGS. 14(*a*) and (*c*) are front views showing the label attaching operation by the label attaching head, whereas FIGS. 14 (*b*) and (*d*) are plan views showing the label attaching operation by the label attaching head.

First, as shown in FIGS. 14(*a*) and (*b*), after the two pairs of suction bars 91, 91 and 92, 92 are raised to the height of the label L held by the take-up member 81 by suction, only the suction bar 91 and the suction bar 92 which are positioned on the side of the label L opposite from the take-up member 81 are closed to sandwich the label L, cooperating with the take-up member 81, and hold the label L by suction. Then, the label L is released from the suction holding by the take-up member 81, and hence, handed over from the take-up member 81 to these suction bars 91 and 92. In this stage, a bottle B to which a label L was attached in the former step is positioned on the bottle supporting base 71.

Figure 15:
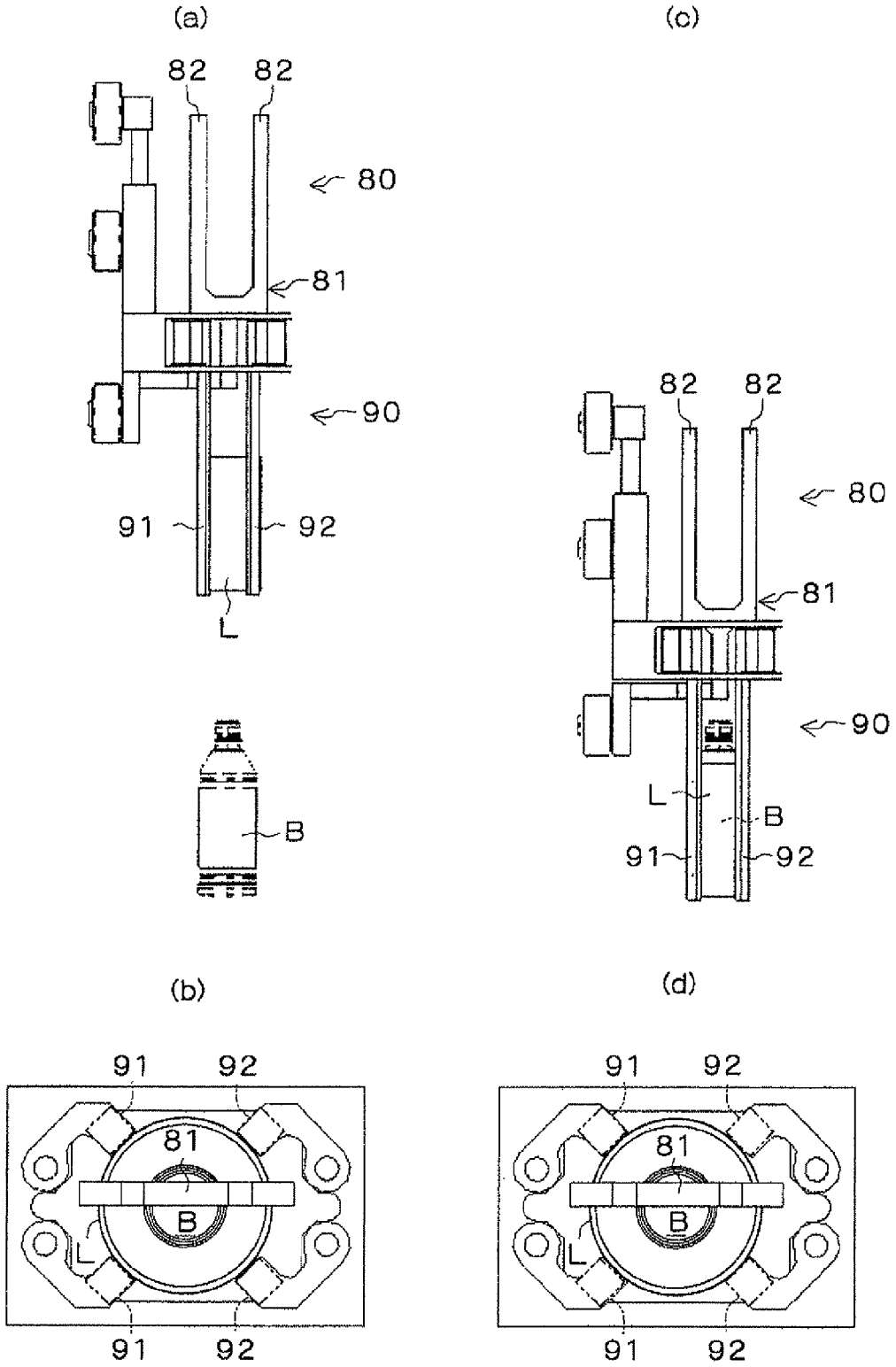
FIGS. 15(*a*) and (*c*) are front views showing the label attaching operation by the label attaching head, whereas FIGS. 15 (*b*) and (*d*) are plan views showing the label attaching operation by the label attaching head.

As shown in FIGS. 14(*c*) and (*d*), when the label opener 90 receives the label L in the above-described manner, the suction bar 91 and the suction bar 92 sucking and holding the label L open to separate the label L from the take-up member 81. Thereafter, as shown in FIGS. 15(*a*) and (*b*), the label handing unit 80 moves upward to retreat the take-up member 81 from the position where the label L is sucked and held by the suction bars 91 and 92. The two pairs of suctions bars 91, 91 and 92, 92 once close to suck and hold the label L and then open, so that the label L is opened.

Then, as shown in FIGS. 15(*c*) and (*d*), the label handing unit 80 and the label opener 90 move downward, so that the label L, which is held open by the two pairs of suction bars 91, 91 and 92, 92, is attached to the body of the bottle B held on the bottle supporting base 71 by suction.

As described above, in the label edge separation unit 50 included in the label supplying device 3, the center in the width direction of the label L is sandwiched between the driving roller 51 and the speed variable roller 54. Further, when the upper end of the label L passes through the sandwiching portion between the driving roller 51 and the speed variable roller 54, the peripheral speed of the speed variable roller 54 is temporarily increased relative to the peripheral speed of the driving roller 51. In this way, the overlapping edges at the upper end of the label L are reliably separated from each other.

In particular, the label edge separation unit 50 includes free rollers 56, 56 that sandwich the label L on the sides of the speed variable roller 54, cooperating with the paired timing feed belts 33, 33. Thus, in separating the upper edges of the label L by increasing the speed of the speed variable roller 54, the portion of the label L near the upper edge does not entirely separate from the timing feed belts 33, 33. This assures smooth and reliable separation of the upper edges of the label L.

Moreover, the driving roller 51 and the speed variable roller 54 sandwiching the label L are in line contact with the label L. Further, the peripheral speed of the driving roller 51 and that of the speed variable roller 54 are made different only when the driving roller 51 and the speed variable roller 54 sandwich the portion near the upper edge of the label L and are kept equal at other times. With these features, the operation to separate the edges of the label by the label edge separation unit 50 does not provide resistance to the operation to transfer the label L by the upstream belt transfer unit 30, and the circumferential surface of the speed variable roller 54 and that of the driving roller 51 do not slide on each other.

Thus, in the process of transfer of the label L by the upstream belt transfer unit 30, the label L does not easily deviate in position. Further, shift of the timing of supplying the label L to the label supply position α does not easily occur. Moreover, the feed belts 33 of the upstream belt transfer unit 30 are not easily worn.

As noted before, in the label supplying device 3, the movement speed of the timing feed belt 43 of the downstream belt transfer unit 40 is adjusted so that the label L is transferred while the shift of the supply timing of the label L due to the deviation in position of the label L is corrected. Thus, the label L is finally stopped at the label supply position α always at the proper timing. Thus, even if the position of the label L is deviated due to the operation of the label edge separation unit 50 to separate the label edges, the timing of supplying the label L to the label supply position α does not shift.

In the above-described embodiment, it is described that upon cutting by the label base material cutting unit 20, the resultant label L will have edges that falsely stick together. Thus, the label edge separation unit 50 is designed to separate apart the upper edges of the label L. However, the present invention is not limited to this. In the case where the edges of the label base material falsely stick together upon cutting the label base material by the label base material cutting unit 20, the label edge separation unit 50 is configured to separate apart the lower edges of the label L. In this case, the peripheral speed of the speed variable roller 54 may be decreased 75 to 50% relative to the peripheral speed of the driving roller 51 when the lower end of the label L passes through the sandwiching portion between the driving roller 51 and the speed variable roller 54.

In the above-described embodiment, the speed of the speed variable roller 54 is increased in the case where the upper edges of the label L are to be separated, whereas the speed of the speed variable roller 54 is decreased in the case where the lower edges of the label L are to be separated. However, the present invention is not limited to this, and it is only necessary that the peripheral speed of the driving roller 51 and that of the speed variable roller 54 are made different. However, deviation in the position of the label L is most effectively prevented by such an arrangement that the speed of the speed variable roller 54 is increased in the case where the upper edges of the label L are to be separated and decreased in the case where the lower edges of the label L are to be separated.

In the above-described embodiment, the free rollers 56, 56 are provided which sandwich the label L on the sides of the speed variable roller 54, cooperating with the paired timing feed belts 33, 33. However, the present invention is not limited to the structure including this kind of free rollers, and the free rollers may not be provided if it does not provide any problems.

Figure 16:
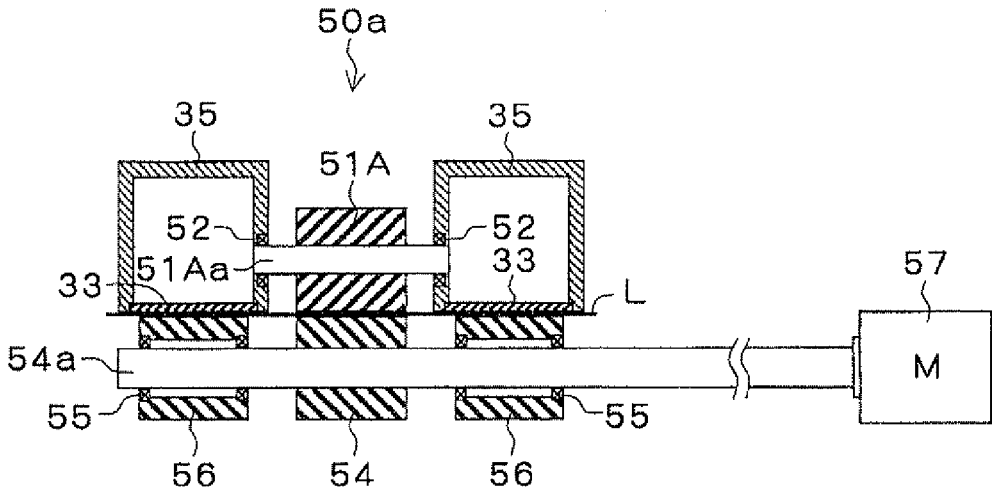
FIG. 16 is a sectional view showing another embodiment of the label edge separation unit.

In the above-described embodiment, the driving roller 51 is provided which sandwiches the label L, cooperating with the speed variable roller 54 and whose peripheral speed is equal to the movement speed of the timing feed belts 33. However, the present invention is not limited to this. For instance, like the label edge separation unit 50*a* shown in FIG. 16, the driving roller 51 may be replaced with a free roller 51A that has a rotation shaft 51A*a* whose ends are simply supported rotatably by a pair of suction chambers 35, 35 via a pair of bearings 52, 52. In this case, however, it is necessary to provide free rollers 56, 56 that sandwich the label L, cooperating with the paired timing feed belts 33, 33.

Figure 17:
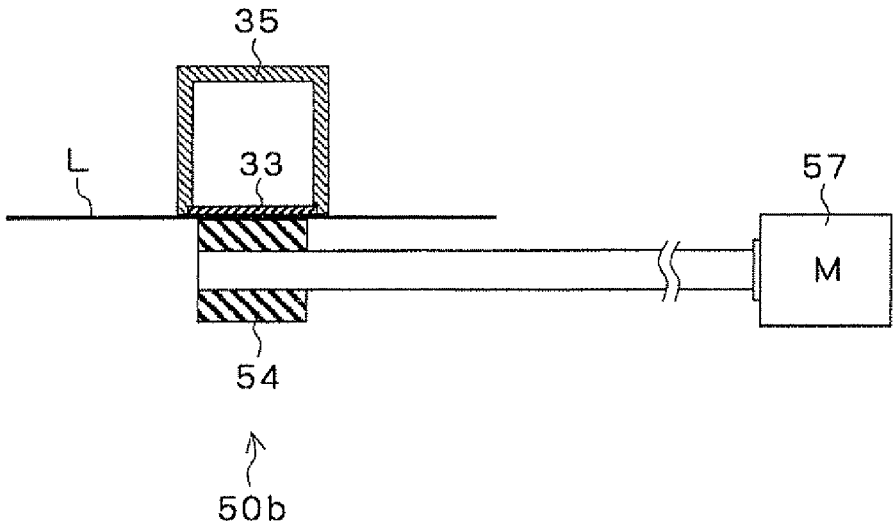
FIG. 17 is a sectional view showing still another embodiment of the label edge separation unit.
Figure 18:
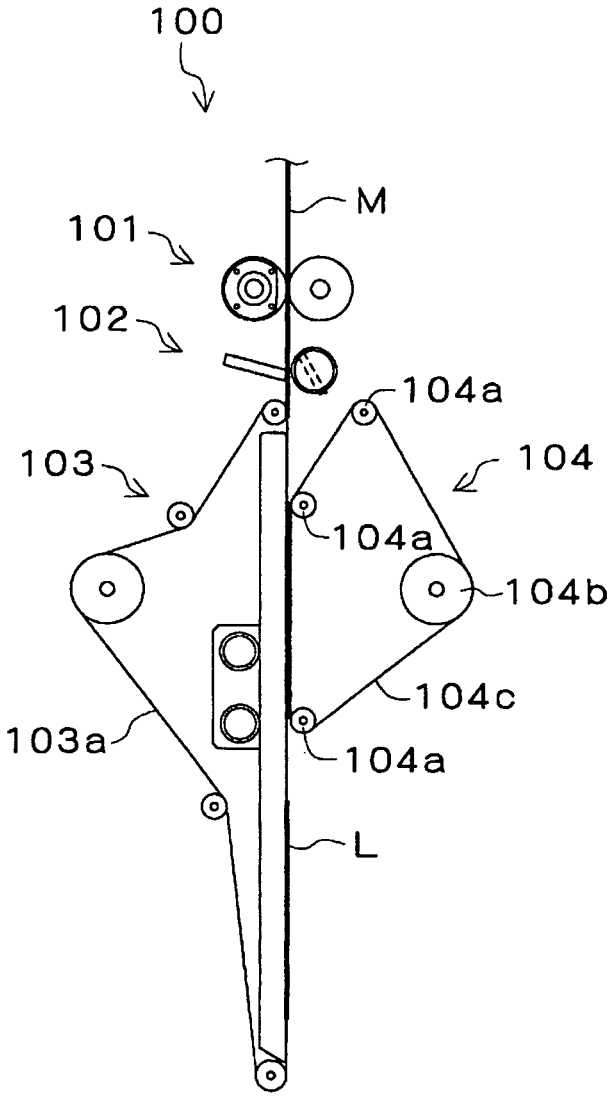
FIG. 18 is a front view showing a conventional label supplying device.

In the above-described embodiment, description is given as to the structure in which the upstream belt transfer unit 30 includes a pair of timing feed belts 33, 33 spaced from each other by a predetermined distance. However, when the upstream belt transfer unit 30 includes only a single timing feed belt 33 that sucks and holds the center of the label L in the width direction, only the speed variable roller 54 that sandwiches the label L, cooperating with the timing feed belt 33, needs to be provided, like the label edge separation unit 50*b* shown in FIG. 17.

Although the speed variable roller 54 is used to separate the upper edges of the label L in the above-described embodiment, the present invention is not limited to this. A speed variable belt mechanism may be employed that includes a speed variable belt wound around a driving pulley and a follower pulley driven by an individual servomotor, and the label L may be sandwiched between the speed variable belt and the driving roller 51, the free roller 51A or the timing feed belt 33 so that the speed variable belt comes into line contact with the label L.

Although the belt transfer unit for transferring the label L to the label supply position α is divided into the upstream belt transfer unit 30 and the downstream belt transfer unit 40 in the above-described embodiment, the present invention is not limited to this. The label L may be transferred to the label supply position α by a single belt transfer unit.

In the above-described embodiment, description is given as to the instance in which the label supplying device of the present invention is mounted to a labeling system. This labeling system includes a label attaching device 4 in which the label attaching head 60 is provided with the label handing unit 80 for handing over the label L to the label opener 90. However, the present invention is not limited to this. The label supplying device of the present invention can be mounted also to a labeling system designed to hand over the label supplied to the label supply position to the label attaching device via a label handing device.

Industrial Applicability

The present invention is applicable in the case where a cylindrical label is to be supplied to a predetermined label supply position in a labeling system for attaching a cylindrical label such as a stretch label or a shrink label to various bottles.

DESCRIPTION OF THE REFERENCE SIGNS

1 labeling system
2 bottle supplying device
3 label supplying device
4 label attaching device
5 bottle discharge device
6 belt conveyor
10 label base material delivery unit
11 driving roller
12 follower roller
20 label base material cutting unit
21 stationary blade
22 rotary blade
30 upstream belt transfer unit
31 follower timing pulley
32 driving timing pulley
33 timing feed belt
33*a* suction hole
34 suction mechanism
35 suction chamber
36 suction assistance means
37 follower timing pulley
38 driving timing pulley
39 timing belt
40 downstream belt transfer unit
41 follower timing pulley
42 driving timing pulley
43 timing feed belt
43*a* suction hole
44 suction mechanism
45 suction chamber
50, 50*a*, 50*b* label edge separation unit
51 driving roller
51A free roller
52 bearing
53 timing pulley
54 speed variable roller
55 bearing
56 free roller
57 servomotor
58*a* label detection sensor
58*b* encoder
59 controller
59*a* parameter storage section
59*b* computation section

59*c* speed variable roller control section
60 label attaching head
70 bottle holder unit
71 bottle supporting base
80 label handing unit
81 take-up member
82 suction bar
90 label opener
91, 92 suction bar
B PET bottle
L shrink label

The invention claimed is:

1. A label supplying device comprising:

a label base material delivery unit for continuously delivering a label base material in a form of an elongated strip;

a label base material cutting unit for cutting, at a predetermined cut pitch, the label base material delivered by the label base material delivery unit, to form cylindrical labels in a state of a folded sheet;

a belt transfer unit for transferring the cylindrical labels one by one to a label supply position; and a label edge separation unit for separating overlapping edges of an end of each of the cylindrical labels in the state of a folded sheet during the transferring of the cylindrical labels by the belt transfer unit:

wherein the belt transfer unit includes a pair of feed belts for transferring the cylindrical labels while holding the cylindrical labels by suction, the feed belts being arranged parallel to each other with a predetermined space therebetween, wherein the label edge separation unit includes:

a first free roller arranged between the paired feed belts of the belt transfer unit and on a side of the cylindrical labels where the feed belts are disposed;

a speed variable roller or a speed variable belt mechanism that is arranged to sandwich the cylindrical labels in line contact with the cylindrical labels by cooperating with the first free roller, the speed variable roller or the speed variable belt mechanism being driven for rotation by an independent servomotor in a direction of transfer of the cylindrical labels;

a pair of second free rollers each arranged to sandwich the cylindrical labels by cooperating with a respective one of the paired feed belts of the belt transfer unit; and a controller for controlling operation of the speed variable roller or the speed variable belt mechanism;

wherein the controller controls the servomotor such that a peripheral speed of the speed variable roller or movement speed of a speed variable belt of the speed variable belt mechanism is equal to a movement speed of the paired feed belts of the belt transfer unit when portions of each cylindrical label other than one end passes through a sandwiching portion between the first free roller and the speed variable roller or the speed variable belt mechanism, whereas the controller controls the servomotor such that the peripheral speed of the speed variable roller or movement speed of the speed variable belt of the speed variable belt mechanism is different from the movement speed of the paired feed belts of the belt transfer unit when said one end of the cylindrical label passes through the sandwiching portion between the first free roller and the speed variable roller or the speed variable belt mechanism.

2. A label supplying device comprising:

a label base material delivery unit for continuously delivering a label base material in a form of an elongated strip;

a label base material cutting unit for cutting, at a predetermined cut pitch, the label base material delivered by the label base material delivery unit, to form cylindrical labels in a state of a folded sheet;

a belt transfer unit for transferring the cylindrical labels one by one to a label supply position; and a label edge separation unit for separating overlapping edges of an end of each of the cylindrical labels in the state of a folded sheet during the transferring of the cylindrical labels by the belt transfer unit:

wherein the belt transfer unit includes a pair of feed belts for transferring the cylindrical labels while holding the cylindrical labels by suction, the feed belts being arranged parallel to each other with a predetermined space therebetween, wherein the label edge separation unit includes:

a driving roller arranged between the paired feed belts of the belt transfer unit and on a side of the cylindrical labels where the feed belts are disposed, the driving roller having a peripheral speed that is equal to a movement speed of the paired feed belts of the belt transfer unit;

a speed variable roller or a speed variable belt mechanism that is arranged to sandwich the cylindrical labels in line contact with the cylindrical labels by cooperating with the driving roller, the speed variable roller or the speed variable belt mechanism being driven for rotation by an independent servomotor in a direction of transfer of the cylindrical labels; and a controller for controlling operation of the speed variable roller or the speed variable belt mechanism;

wherein when portions of the cylindrical labels other than one end pass through a sandwiching portion between the driving roller and the speed variable roller or the speed variable belt mechanism, the controller controls the servomotor such that peripheral speed of the speed variable roller or movement speed of a speed variable belt of the speed variable belt mechanism is equal to movement speed of the paired feed belts of the belt transfer unit, whereas when the one end of the cylindrical labels passes through the sandwiching portion between the driving roller and the speed variable roller or the speed variable belt mechanism, the controller controls the servomotor such that the peripheral speed of the speed variable roller or movement speed of the speed variable belt of the speed variable belt mechanism is different from the movement speed of the paired feed belts of the belt transfer unit.

* * * * *